United States Patent [19]

Lacoste

[11] 4,286,613

[45] Sep. 1, 1981

[54] APPARATUS FOR AND METHOD OF FREEZE PROTECTING PLUMBING

[76] Inventor: Marvin Lacoste, P.O. Box 292, Kiln, Miss. 39556

[21] Appl. No.: 112,485

[22] Filed: Jan. 16, 1980

[51] Int. Cl.[3] ..... E03B 7/12

[52] U.S. Cl. ..... 137/62; 137/79; 137/317; 138/34; 138/35; 237/80

[58] Field of Search ..... 137/59, 62, 79, 315, 137/317; 138/32, 34, 35; 237/80

[56] References Cited

U.S. PATENT DOCUMENTS

| | | | |
|---|---|---|---|
| 1,268,648 | 6/1918 | Van Meter | 137/62 |
| 1,338,469 | 4/1920 | Waage et al. | 137/62 |
| 1,554,344 | 9/1925 | Haapanen | 137/62 |
| 1,558,276 | 10/1925 | Peterson | 137/62 |
| 1,786,878 | 12/1930 | Keuren | 137/62 |
| 3,320,965 | 5/1967 | Morgan | 137/62 |
| 3,369,556 | 2/1968 | Allderdice | 137/62 |
| 3,397,711 | 8/1968 | Strange | 137/62 |
| 3,618,625 | 11/1971 | Walters | 137/62 |
| 4,066,090 | 1/1978 | Nakajima et al. | 137/62 |

*Primary Examiner*—Arnold Rosenthal
*Assistant Examiner*—G. L. Walton
*Attorney, Agent, or Firm*—James B. Lake, Jr.

[57] ABSTRACT

A gate valve, mounted in a drain pipe connected to a downstream exposed end of a part of a plumbing system subject to occasional freezing, is controlled to open and close by opposed pressures of a spring and a temperature controlled pressure of a refrigerant fluid in an expansible and contractable bellows, the respective pressures being equalized at 33 degrees F. with gate valve closed, the pressure differentials therebetween resulting from temperature changes progressively opening and closing valve at temperatures below 33 degrees F. and closing it and keeping it closed at 33 degrees F. and above, and thereby preventing the plumbing from freezing, by allowing water to flow therethrough at and below freezing.

1 Claim, 2 Drawing Figures

APPARATUS FOR AND METHOD OF FREEZE PROTECTING PLUMBING

FIELD OF INVENTION

The invention relates generally to plumbing, and more particularly to apparatus for and method of freeze protecting plumbing that may be exposed occasionally to freezing and below freezing temperatures.

DISCUSSION OF THE PRIOR ART

Heretofore taps or faucets have been allowed to drip to keep plumbing from freezing by allowing a slow flow of water therethrough. When the taps were opened manually, they were often not opened in time or enough, so that a variety of automatic opening devices are found in the prior art. These automatic opening devices are broadly divided into two groups, those that automatically drip or slowly flow water from plumbing outlets, and those that automatically drain all the water out of the plumbing. In the first category are Nakajima et al., U.S. Pat. No. 4,066,090; and Allderdice, U.S. Pat. No. 3,369,556. In the second category are Morgan U.S. Pat. No. 3,320,965; Milone, U.S. Pat. No. 1,820,473; and Peterson, U.S. Pat. No. 1,558,276.

Nakajima teaches a manually operated water cock or tap in which a heat-sensitive valve element is inserted in the tap that is adapted to open and close a bypass around the manually operated valve at freezing temperatures and below. The heat sensitive element is wax which contracts in freezing temperatures to shorten the length of an operating valve shaft 63 that a coil spring 75 is adapted to raise and open said bypass, allowing water to flow out of the tap, the flow being inversely proportional to the drop in temperature below to the rate of water flow from the outlet, within the limits of bypass size. Allderdice teaches a heat sensitive valve that is connected directly in the plumbing system, the valve being actuated by the freezing of water in a bellows to elongate it forcing a valving element off its seat to flow water from the plumbing therethrough against a spring bias seating the valving element. Hopefully the water in the bellows froze before the water in the plumbing or no flow would result.

In the second category, Morgan, Milone and Peterson all drain the plumbing of liquid to prevent its freezing, rather than flowing it continuously and at a sufficient rate of flow to prevent its freezing in the plumbing.

The invention differs from Allderdice in that its heat sensitive actuating fluid is not water and can never freeze before actuating a water flow from the plumbing to prevent its freezing within the occasional freezing range protection provided. Also the actuating elements of the invention are separate from connection to the plumbing while those of Allderdice are integral thereby subjecting the same actuating fluid in its bellows to the same freezing temperature as the fluid in the plumbing. The invention differs similarly from Nakajima in that Nakajima connection to the plumbing and its heat sensitive element are integral and cannot be separated to place each in its most favorable position as with the invention.

BACKGROUND OF THE INVENTION

It is an object of the invention to provide apparatus for and a method of protecting plumbing from occasional freezing temperatures and below.

Another object of the invention is to provide an actuating element separate from a bleed connection to the plumbing so that each can be mounted in respective positions most favorable to their respective functions and a maximum joint result.

DETAILED DESCRIPTION OF THE INVENTION

Figure 1:
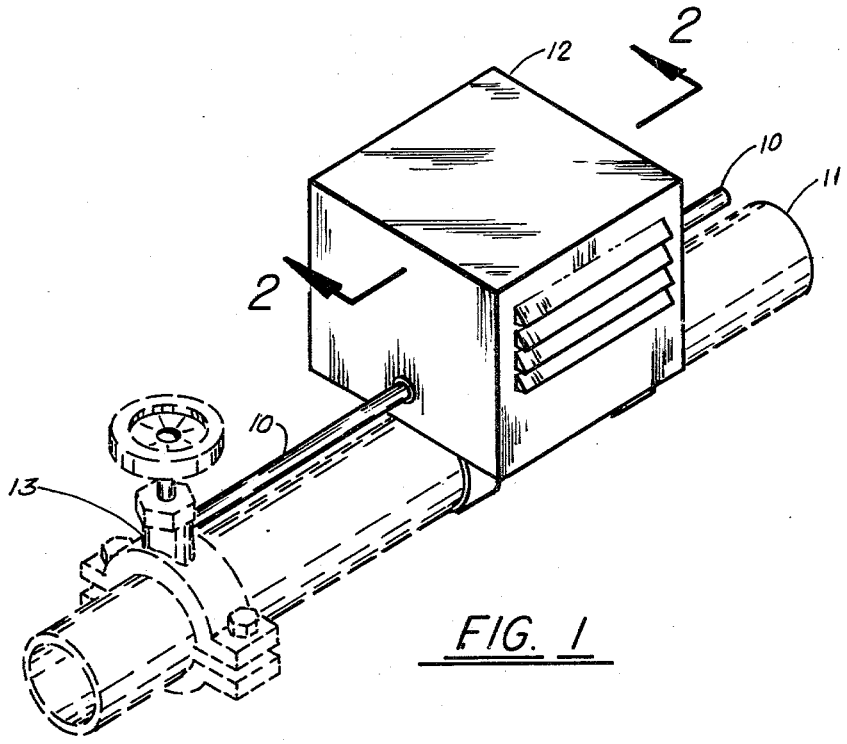
FIG. 1 is a three dimensional drawings of the invention operably connected to protect an exposed part of a plumbing system.
Figure 2:
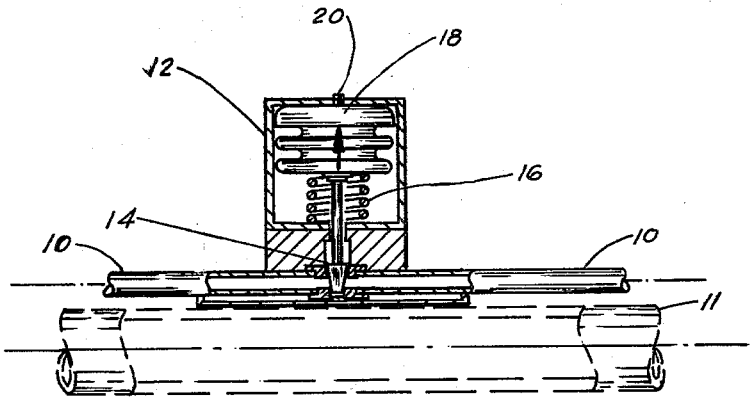
FIG. 2 is a cross-sectional view taken along section lines 2—2 of FIG. 1.

Referring to FIGS. 1 and 2, the invention comprises a drain pipe connecting means 10 including a bleed valve 13 being detachably connectable to a plumbing system 11 at any exteriorly exposed point downstream end thereof for bleeding fluid from the plumbing system. Drain pipe connecting means 10 extends through a housing 12 and is extendable to a nearest convenient drain. A gate valve 14 is mounted in pipe 10 within said housing, and biased upwardly from a closed position, as shown in FIG. 2, by a coil spring 16 having a constant pressure of 69.9 lbs/sq. in. An expandable and contractable bellows 18 is secured to the top of housing 12, and the depending bellows end is fixed to gate valve 14. The bellows is charged through charging valve 20 with a refrigerant such as "Freon 502" to a pressure of 69.9 lbs./sq. in. at a temperature of 33 degrees F., that is to a pressure equal and opposite to said constant spring pressure to keep said gate valve closed at said temperature and for all higher temperatures. When the ambient temperature drops below 33 degrees F. the constant pressure of spring 16 exceeds the "Freon 502" pressure in the bellows and opens said gate valve progressively to completely open at 27 degrees F. and below, thereby causing water to flow through the exposed part 13 of the plumbing system 11 at an increasing rate as the temperature falls. Housing 12 is mountable at any convenient place, but preferably in a colder and more exposed place than the protected part of the plumbing system to ensure that water flows therethrough before freezing occurs. The housing is louvered to ensure that the bellows are exposed to ambient temperature.

"Freon 502" is generally obtainable from refrigerant and air-conditioning stores, and more particularly obtainable from Sporlan Valve Co. of St. Louis, Mo. A chart of the "Freon 502" equivalent pressures and temperatures follows:

| | |
|---|---|
| 0 | 31.1 |
| 27 | 61.5 |
| 33 | 69.9 |
| 60 | 116.4 |
| 90 | 187.4 |

What is claimed is:

1. In a plumbing system subjected to ambient freezing temperatures, includes an apparatus for freeze protecting said plumbing system, said apparatus comprising:

(a) drain pipe connecting means extending parallel to the plumbing system from the warmest ambient environment to the ambient coldest environment thereof and to a drain means;

(b) bleed valve means mounted in said plumbing system in said warmest ambient environment and joined to said connecting means for the bleeding off of liquid from said plumbing system;

(c) gate valve means mounted in said connecting means at said coldest ambient environment for opening and closing said connecting means to said drain;

(d) thermostat means mounted adjacent said gate valve means and operably connected thereto for actuating said gate valve to open before freezing temperature is reached in the coldest ambient environment, and to close at temperatures above said freeze opening temperature for ensuring a liquid flow through said plumbing system before liquid can freeze in any part of said plumbing and drain pipe connecting means;

(e) all said means being detachable from the plumbing system as a single unit and placed at any exterior point along the plumbing system to bleed off liquid from the plumbing system through the gate valve means to the drain means.

* * * * *